US008104764B2

(12) United States Patent
Saltsov et al.

(10) Patent No.: US 8,104,764 B2
(45) Date of Patent: Jan. 31, 2012

(54) BANKNOTE CASSETTE

(75) Inventors: Leon Saltsov, Thornhill (CA); Mykhaylo Kucherenko, Maple (CA); Sergiy Bukhman, Toronto (CA); Olga Sydorchenko, legal representative, Toronto (CA); Oleksandr Onipchenko, Msple (CA); Andriy Kyselov, Thornhill (CA)

(73) Assignee: Crane Canada Co., Concord (CA)

( * ) Notice: Subject to any disclaimer, the term of this patent is extended or adjusted under 35 U.S.C. 154(b) by 369 days.

(21) Appl. No.: 11/990,597

(22) PCT Filed: Aug. 17, 2006

(86) PCT No.: PCT/CA2006/001346

§ 371 (c)(1),
(2), (4) Date: Nov. 27, 2009

(87) PCT Pub. No.: WO2007/019694

PCT Pub. Date: Feb. 22, 2007

(65) Prior Publication Data

US 2010/0102502 A1 Apr. 29, 2010

(30) Foreign Application Priority Data

Aug. 19, 2005 (CA) ..... 2516549

(51) Int. Cl.
*B65H 1/00* (2006.01)

(52) U.S. Cl. ..... 271/145; 271/162

(58) Field of Classification Search ..... 271/145, 271/147, 162; 232/1 D, 15, 16
See application file for complete search history.

(56) References Cited

U.S. PATENT DOCUMENTS 5,730,271 A * 3/1998 Buchman et al. ..... 194/206
6,712,352 B2 * 3/2004 Bergeron et al. ..... 271/180

* cited by examiner

*Primary Examiner* — Michael McCullough

(57) ABSTRACT

A banknote cassette advantageously uses injection molded endcaps to capture and secure a connecting sleeve to collectively form a generally rectangular housing of the banknote cassette. A movable access lid cooperates with the endcaps and connecting sleeve for locking of the cassette. Preferably, a banknote slot is formed as part of one of the endcaps to provide precision in the size of position of the banknote slot. The endcaps can be used with different sized connecting sleeves to simplify the manufacture of different capacity banknote cassettes. Preferably, the connecting sleeve is of a metal material.

10 Claims, 12 Drawing Sheets

BANKNOTE CASSETTE

FIELD OF THE INVENTION

The present application relates to a banknote validator system and in particular, relates to an improved banknote cassette used with the banknote validator system.

BACKGROUND OF THE INVENTION

It is now common place to have unattended payment terminals where a customer provides payment in the form of banknotes to a banknote validator system that confirms the validity of the banknotes as part of the payment process. Typically, the banknote validators are associated with vending equipment, gaming machines or other payment terminals.

The actual banknote validator system can be quite sophisticated and include a banknote accumulator which allows the recycling of banknotes as necessary, to provide change for a particular transaction. In other applications, the system merely includes a banknote validator and an associated banknote cassette for storing and stacking of received banknotes. The banknote cassette is removable from the system by an operator. Typically, a banknote cassette is removed and a new empty banknote cassette is inserted. The banknote cassettes are typically locked and the contents thereof are not accessible without additional security provisions being met.

Banknote cassettes have traditionally been made of a number of different materials and designs. The cassettes are typically of a rectangular configuration and initially were metal boxes with an access door provided in the bottom thereof. One side of the banknote cassette includes an interior stacker mechanism and the opposite side of the banknote cassette includes a large storage area for receiving stacked banknotes. A banknote slot and guide arrangement is provided adjacent the stacker mechanism that receives banknotes from the validator. The stacker mechanism forces a received banknote through the guide arrangement and into a storage area provided to one side of the guide arrangement where the banknotes are maintained in a stack. A pressure plate was provided in the storage arrangement for engaging the first banknote to be added to the storage arrangement and a spring bias arrangement urges the pressure plate against the stack of banknotes.

Power for moving of the stacker arrangement from an initial compressed state to one side of the guide arrangement to an extended state pushing the banknote through the guide arrangement and into the storage area is provided by a transfer mechanism or drive member exposed to the exterior of the banknote cassette. Many of these banknote cassettes are made of a metal construction that allows the walls of the banknote cassette to be relatively thin while providing excellent security. As can be appreciated, the structural integrity of the banknote cassette is important as service personnel will be removing these cassettes and transporting them to a distant secure environment. The possibility of tampering with the banknote cassette remains high and thus, security is critical.

In some environments such as the gaming environment, the possibility of physically damaging of the banknote cassette is less, however, the cassette must provide a system where it is not possible to withdraw the banknotes without authorized opening of the access door. Some banknote cassettes also include a removable memory device to record the number and amount of the banknotes stored in the cassette.

There are applications for banknote cassettes where security is somewhat less important. In this case it has been known to produce banknote cassettes with a plastic housing while the cassette remains lockable. More recently, it has been proposed to produce a banknote cassette where the actual box of the cassette is a single molded plastic component with a hinged lockable access door. Allegedly, plastic cassettes are more durable and resistant to damage caused by dropping of the cassette.

Banknote cassettes are not necessarily of the same capacity. Basically, the banknote cassette is designed to store a certain number of banknotes before service is required. A small capacity banknote cassette may store 100 banknotes whereas other applications require storage of several hundred banknotes. Basically, the depth of the banknote cassette changes with the capacity thereof.

Plastic molded cassettes have certain advantages with respect to resiliency and are less prone to damage if the cassette is dropped. Metal cassettes are typically more secure but somewhat more prone to damage if dropped.

It would be desirable to provide a banknote cassette design which is economical to manufacture and easily varied to accommodate a particular capacity.

SUMMARY OF THE INVENTION

A banknote cassette for receiving and stacking of banknotes according to the present invention comprises a rectangular housing selectively closed at one end by a movable access lid. The rectangular housing includes two plastic molded endcaps forming opposite walls of the housing and cooperating with a sleeve defining three connected walls of the housing. The plastic molded endcaps interconnect with the sleeve portion to provide the rectangular housing with the interior thereof being accessible through the access lid.

According to an aspect of the invention, one endcap of the banknote cassette is a stacker endcap having an interior surface adapted to receive a stacker mechanism to one side of a banknote slot provided in said cassette.

According to a further aspect of the invention, the other endcap is a storage endcap adapted to hingedly engage the access lid.

In a preferred aspect of the invention, each end cap includes recessed walls receiving and locking with securing portions of said sleeve interior to said endcaps.

According to a different aspect of the invention, the storage end cap includes an interior molded spring retainer that engages and retains a bias spring connected to a movable banknote pressure plate.

In a further aspect of the invention, the sleeve is mechanically secured to the storage endcap and the stacker endcap.

In a further aspect of the invention, the stacker endcap is elongate and includes a recessed end wall that receives a drive portion of said stacker mechanism exposed on the exterior of the cassette.

In yet a further aspect of the invention, the exposed drive portion of the stacker includes a banknote slot for receiving banknotes into said cassette.

In a further aspect of the invention, the exposed drive portion includes drive rollers on opposite sides of the banknote slot.

In yet a further aspect of the invention, the exposed drive portion includes a drive gear of the stacker mechanism.

In a different aspect of the invention, the stacker endcap includes alignment slots on one end thereof and latching recesses in sidewalls and an end wall of the stacker endcap.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
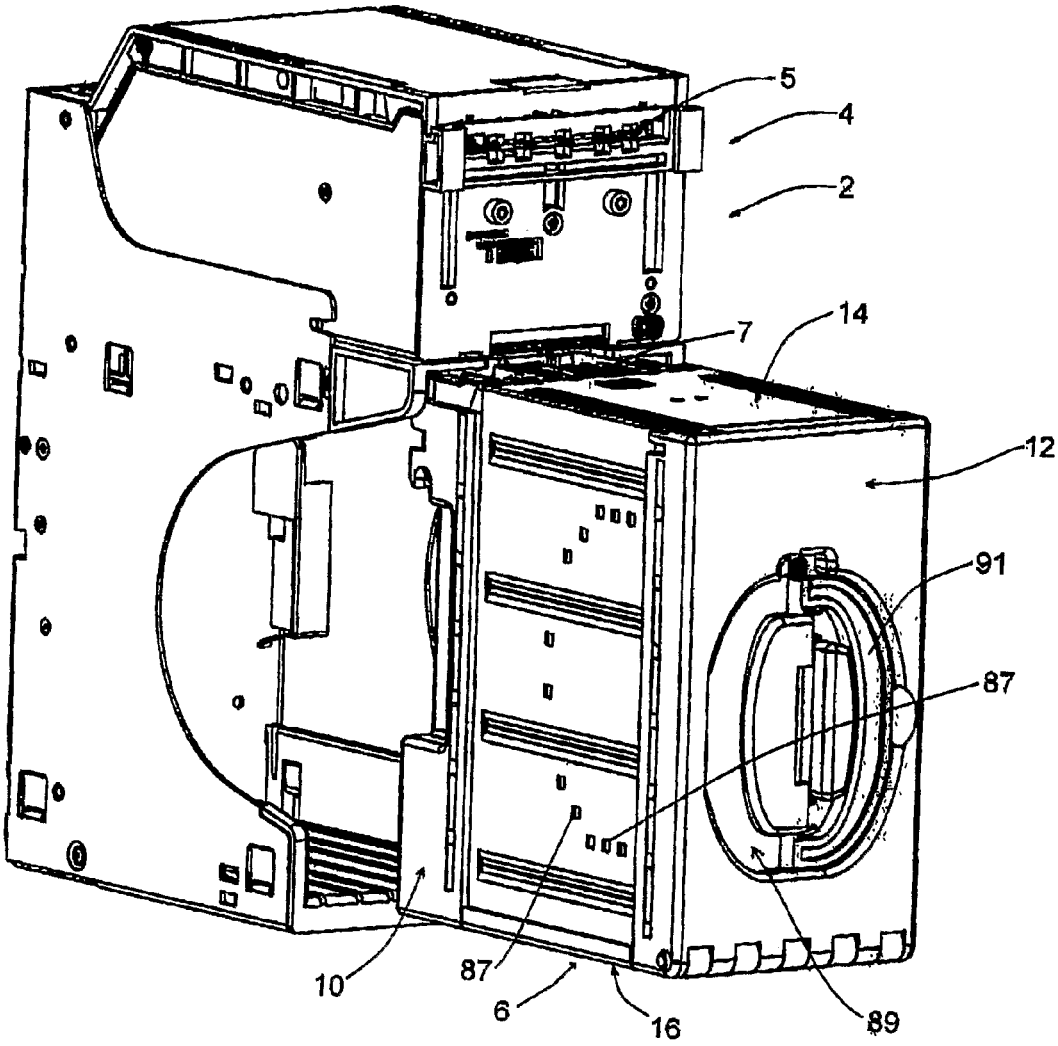
FIG. 1 is a perspective view of a banknote validator system with a banknote cassette about to be received therein.
Figure 2:
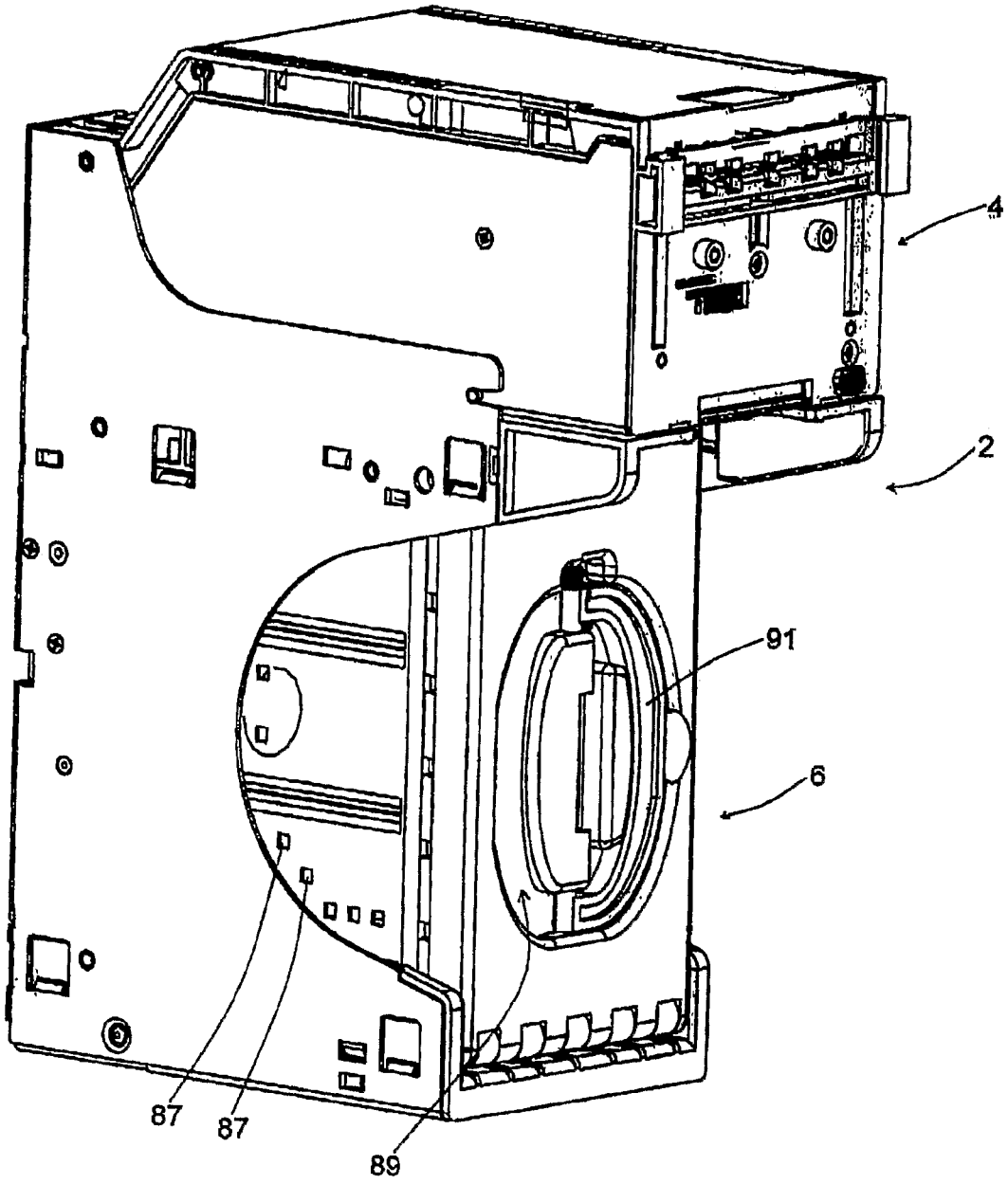
FIG. 2 is a view similar to FIG. 1 with the banknote received in a banknote validator system.

FIG. 1 shows a banknote validator system 2 having a banknote validator 4 which releasably receives the banknote cassette 6. Banknotes are received through the banknote slot 5 of the validator and are analyzed for authenticity. If the validator 4 determines a banknote to be acceptable, it is processed through the validator and passed into the banknote cassette 6 through the banknote slot generally shown as 7. In more sophisticated validator systems, the banknote cassette may be separated from the validator by further components.

The banknote cassette 6 has a generally rectangular housing 8 defined by the plastic molded stacker endcap 10, the plastic molded storage endcap 12, and the interconnecting sleeve 14. These components cooperate to define five sides of the rectangular housing 8 and the hinged access lid 16 forms the sixth side to allow selective closure of the rectangular housing. Preferably the interconnecting sleeve is of a stamped metal component and the access lid 16 is of a molded plastic construction.

The molding of the stacker endcap 10 and the storage endcap 12 is relatively straightforward as these components are relatively shallow and each endcap is generally open to the interior thereof. The stacker endcap 14 also receives a stacker mechanism 28. The stacker mechanism 28 cooperates with the stacker endcap 14 to define locking recesses 24 and 26 which accommodate the lock cylinders 20 and 22 provided at the free end 18 of the access lid 14. Suitable latching arrangements are provided on the lock cylinders for engaging latching surfaces of the molded stacker endcap 14.

Figure 3:
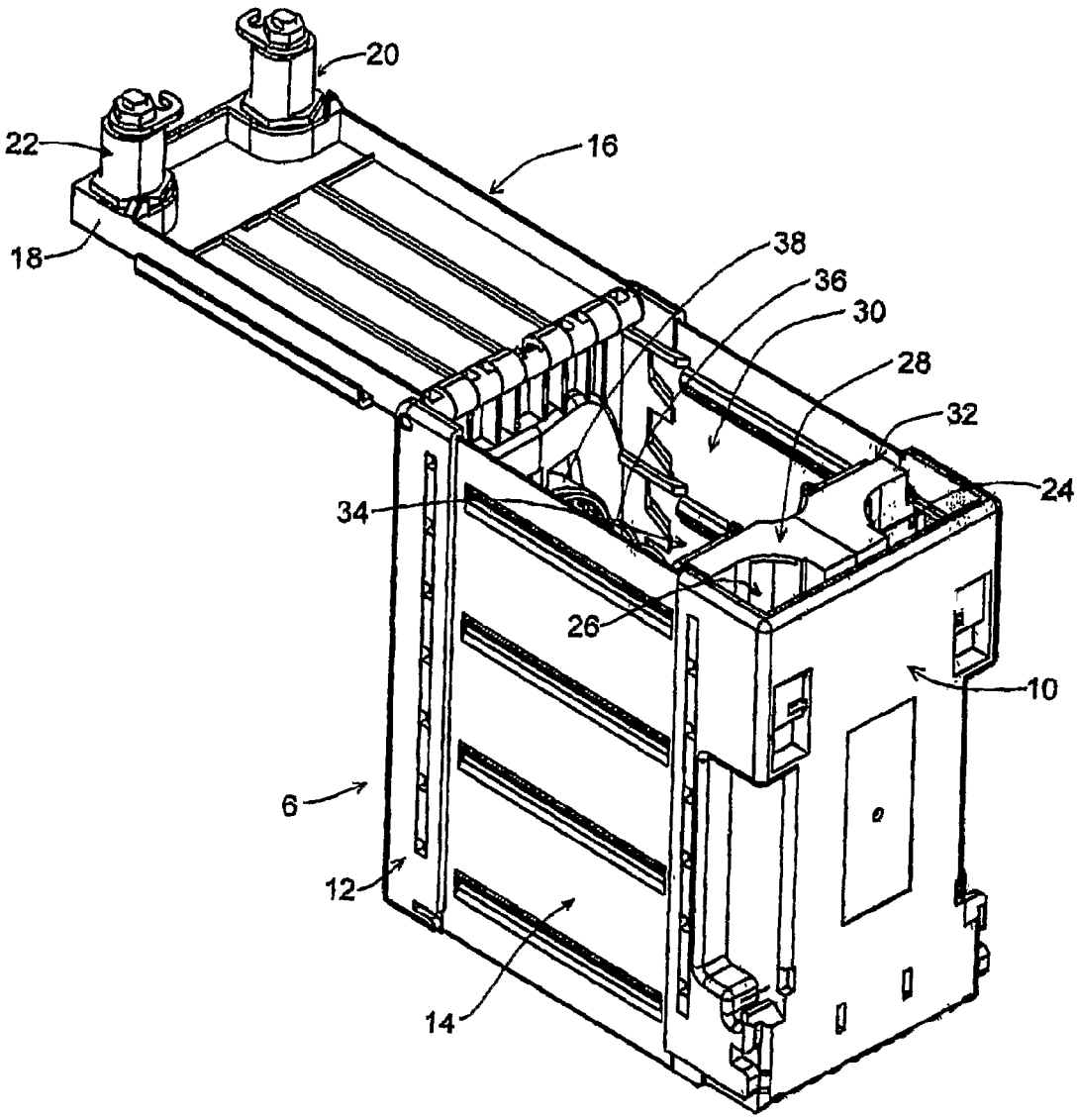
FIG. 3 is a perspective view of the banknote cassette with the access door in an open configuration.

In FIG. 3, the banknote cassette 6 is shown with the access lid 16 open such that the storage area 30 is accessible. This storage area receives and stacks banknotes between a backface 32 of the stacker mechanism 30 and a spring biased pressured plate 34. The pressure plate 34 is biased by the spring member 36 retained within securing recess 38, molded into the storage endcap 12.

Figure 4:
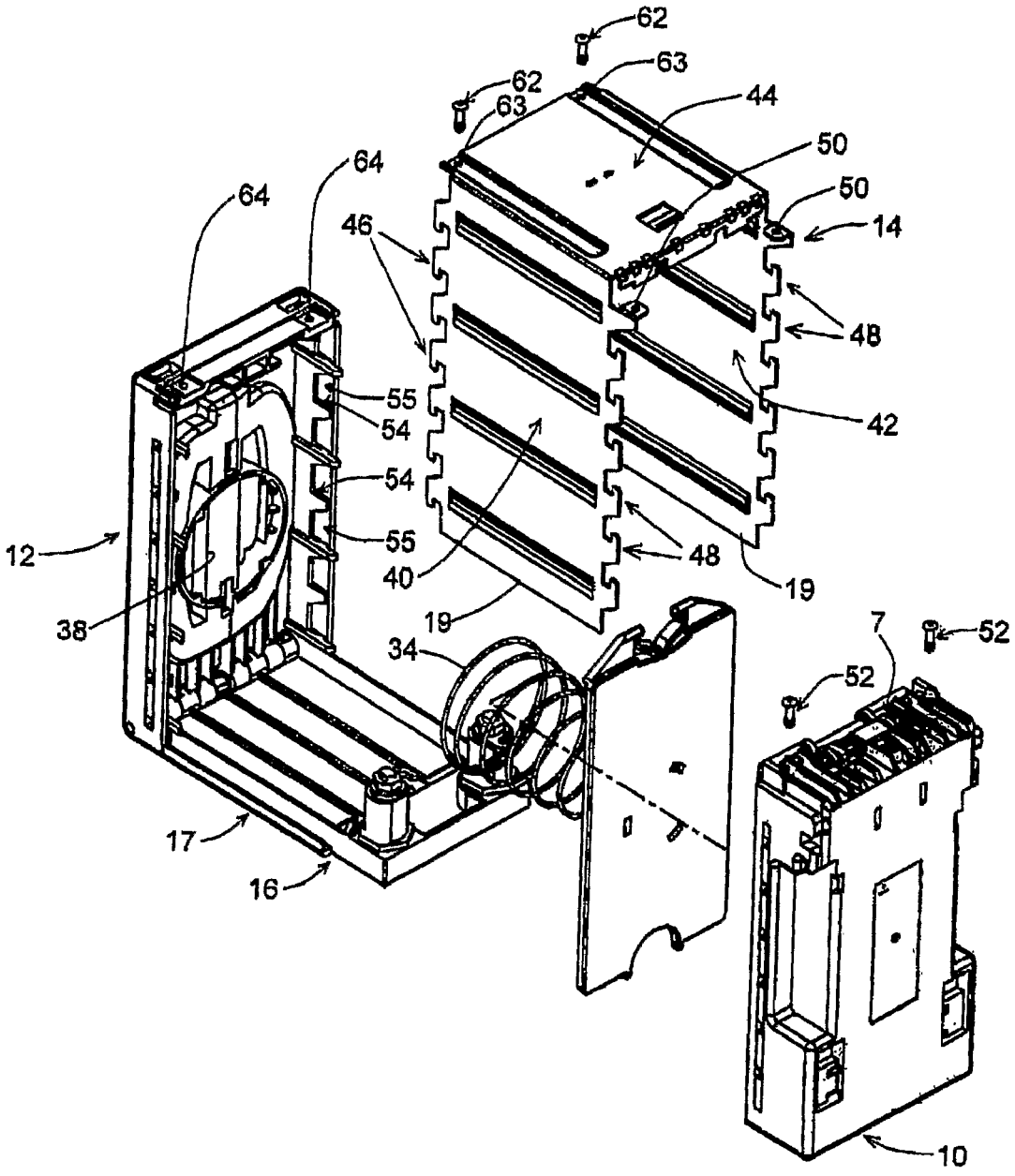
FIG. 4 is an exploded perspective view of the banknote cassette.

FIG. 4 shows the general principles of assembly of the interconnecting sleeve 14 with the storage endcap 12 and the stacker endcap 10. The interconnecting sleeve 14 has opposed side walls 40 and 42 joined by the connecting end wall 44. This sleeve is preferably a stamped metal component with suitable reinforcing channels provided in the side walls 40 and 42. Each side wall 40 and 42 includes downwardly extending securing hooks 46 for engaging locking recesses 54 provided on each side of the storage endcap 12. The side walls 40 and 42 include upwardly extending securing hooks 48 for engaging locking recesses provided on the interior edges of the stacking endcap 10. The securement of the interconnecting sleeve 14 to the storage endcap 12 and the stacker endcap 10 are illustrated in the sectional view of FIG. 7. The securing hooks 46 can be received within the recess cavity 55 in the side wall of the storage endcap 12 and then moved downwardly into the locking recess 54. The sleeve 14 is then positively retained in the storage endcap and securing rivets 62 pass through holes 63 in the connecting end wall 44 and are held in the securing flanges 64 of the storage endcap 12.

Figure 7:
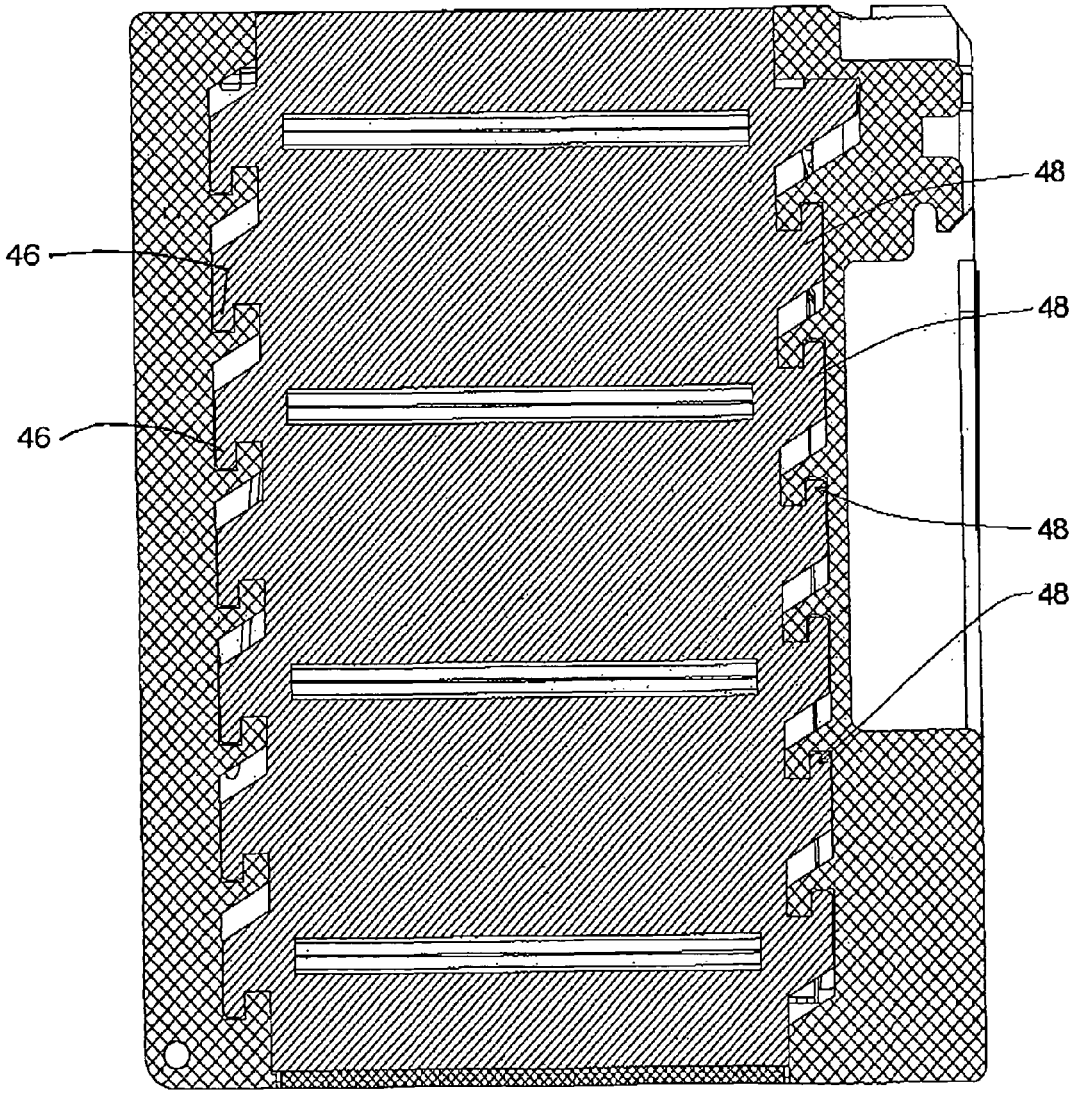
FIG. 7 is a sectional view through the banknote cassette.

The upwardly extending hooks 48 have a similar cooperation with locking recesses provided in the storage endcap 12 as shown in FIG. 7. In this case, securing rivets 52 pass through the locking tabs 50 and are engaged and retained in the stacker endcap 10. This particular locking arrangement provides a secure rectangular housing 8 that is selectively closed on the one end by the access lid 16. The access lid 16 includes outwardly extending flange portions 17 either side of the lid that extend over and cover the exposed edges 19 of the interconnecting sleeve 14.

The stacker endcap 10 includes exposed alignment ribs 85 that act as guide surfaces for registering the banknote cassette with the frame of the banknote validating system 2. The storage endcap 12 includes a recess 89 in an exterior surface that receives and retains the foldaway handle 91.

Figure 5:
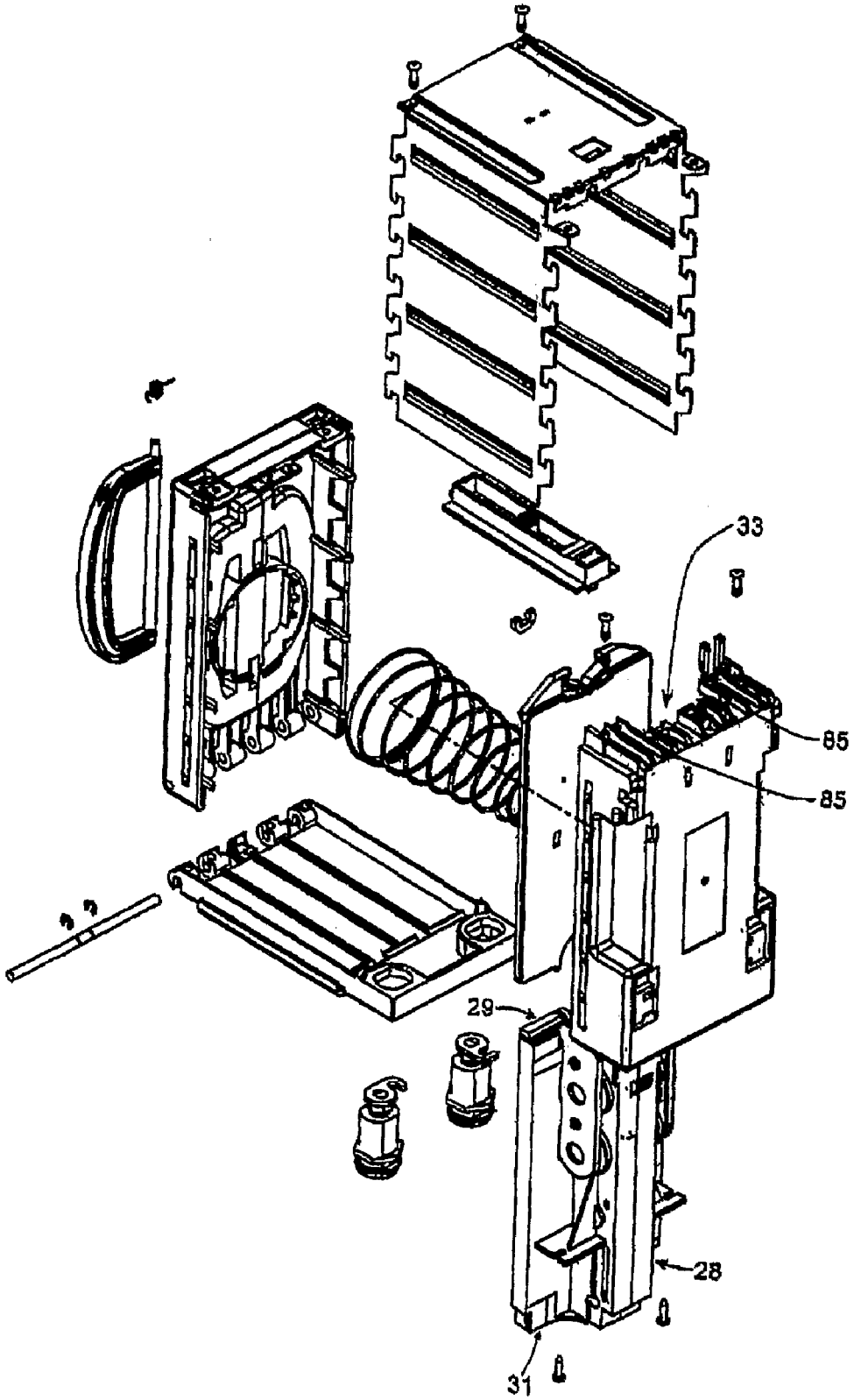
FIG. 5 is an exploded perspective view of the banknote cassette showing additional details of the stacker mechanism received in the stacker end cap.
Figure 6:
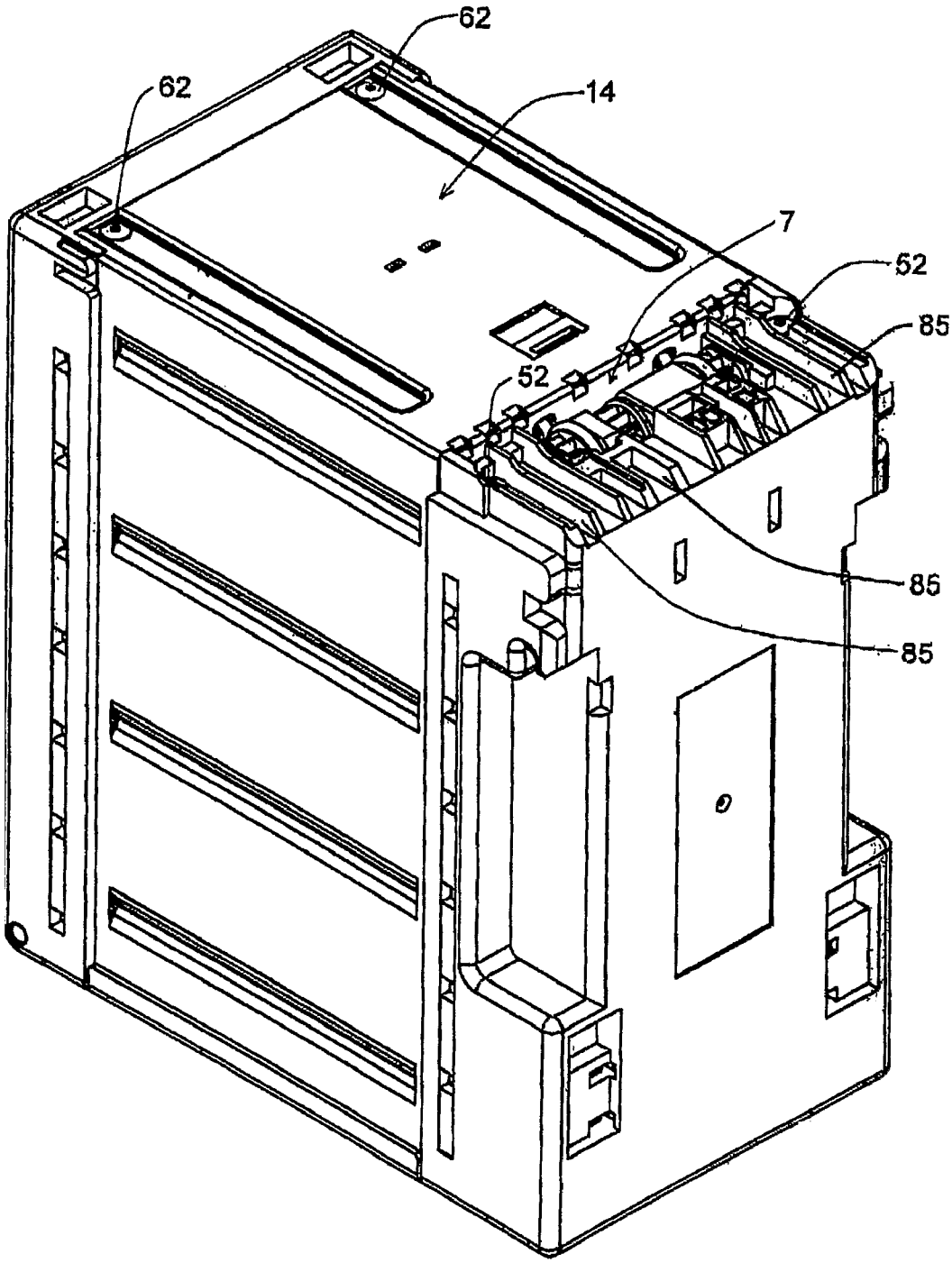
FIG. 6 is a perspective view of the banknote cassette showing the closed end thereof.
Figure 8:
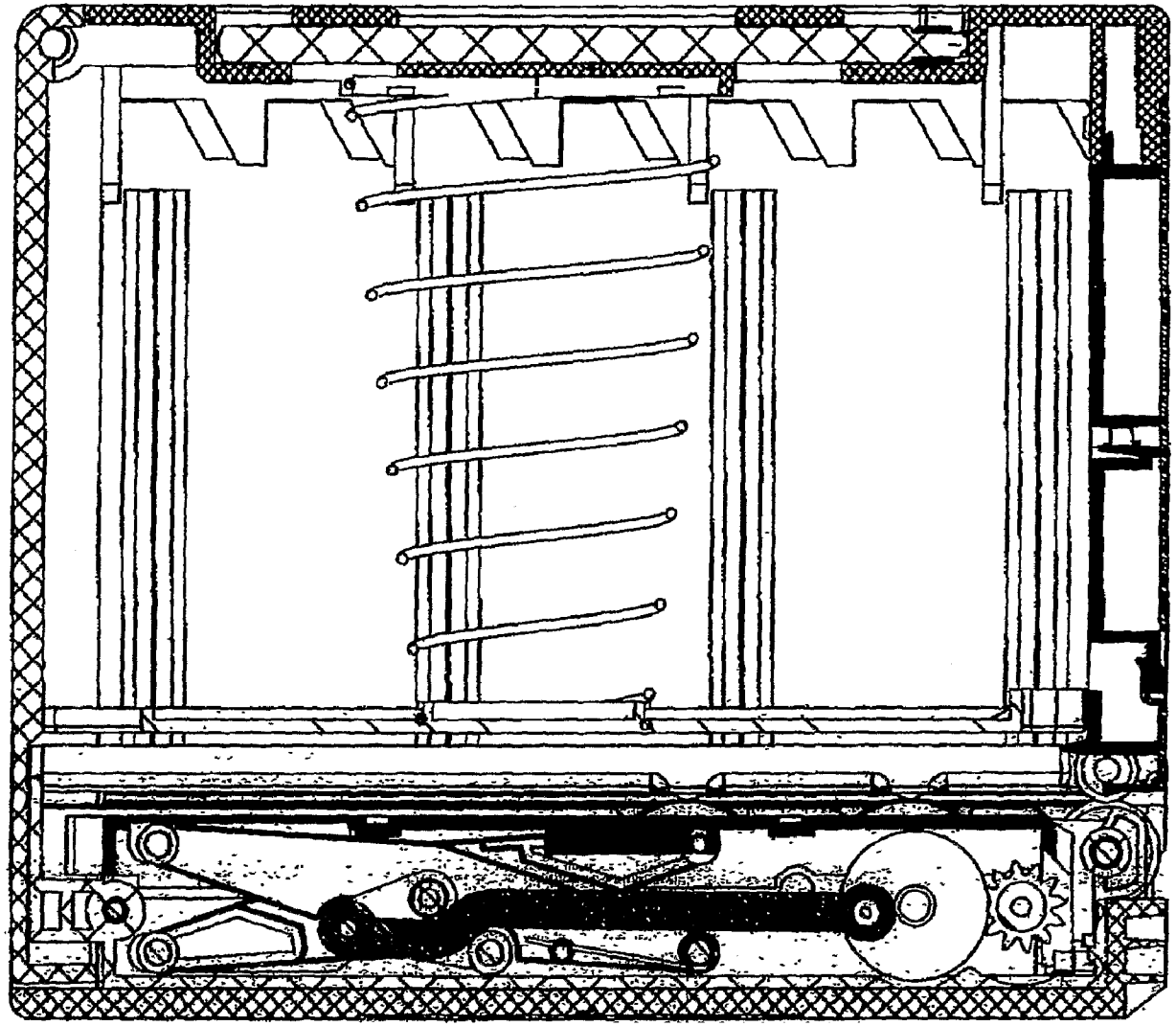
FIG. 8 is a sectional view through the banknote showing details of the stacker mechanism and the pressure plate provided in the storage arrangement.

The stacker mechanism 28 as shown in FIG. 5 includes a first end 31 which cooperates with the stacker endcap 10 to provide the recesses 24 and 26 for receiving the locking cylinders 20 and 22 of the lid 16. The end 29 of the stacker mechanism 28 is provided at the opposite end of the stacker endcap 10 and closes the inwardly directed recess 33. Basically, the stacker mechanism which is releasably held in the stacker endcap 10, defines the banknote slot through which banknotes are received for storage in the banknote cassette 6. In addition, it includes the mechanism for moving a pusher mechanism through the guide arrangement to add a banknote received in the banknote slot to the stack of banknotes provided in the banknote cassette. With this arrangement, the assembly of the stacker mechanism is completed before connection to the stacker endcap 10. As shown in the cross sectional view of FIG. 8, the stacker mechanism 28 includes a series of gears and levers and thus the separate assembly of this component is desired. It also includes various rollers and gears provided at the exposed end of the stacker endcap which receives the banknotes. The use of a separate stacker assembly simplifies the manufacture and assures an accurate arrangement for receiving of banknotes into the banknote cassette.

As can be appreciated from a review of FIG. 4 and FIG. 3, the stacker mechanism 28 forms part of the ends of the stacker endcap 10. The access lid 16 covers the stacker mechanism 28 when it is closed whereas the banknote slot of the stacker mechanism and the various drive components are exposed at the opposite end of the stacker endcap 10.

Figure 9:
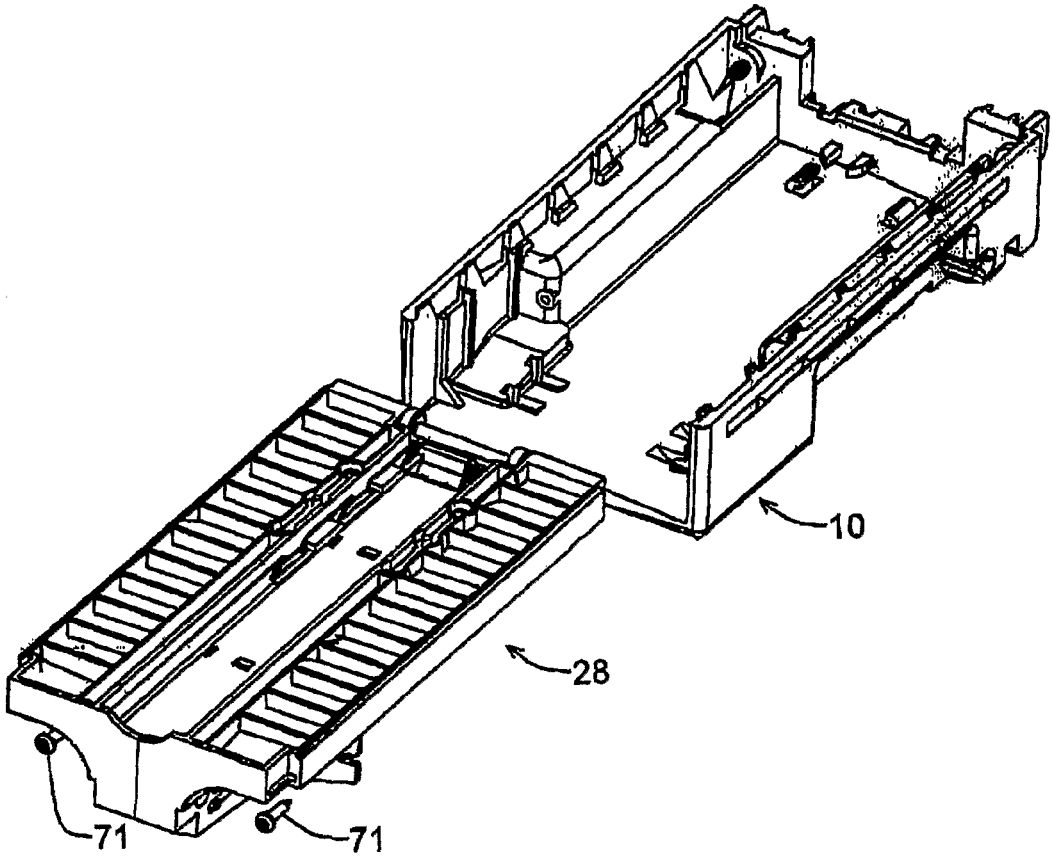
FIG. 9 is an exploded perspective view showing the cooperation between the stacker mechanism and the stacker end cap.

Assembly of the stacker mechanism 28 to the stacker endcap 10 is shown in FIG. 9. The various linkages for the stacker mechanism 28 are provided in a central portion of the stacker mechanism 28 and various slide arrangements are provided for retaining of the stacker mechanism 28 in the stacker endcap 10. Suitable securing pins 71 can be provided securing of the stacker mechanism in the stacker endcap.

Figure 10:
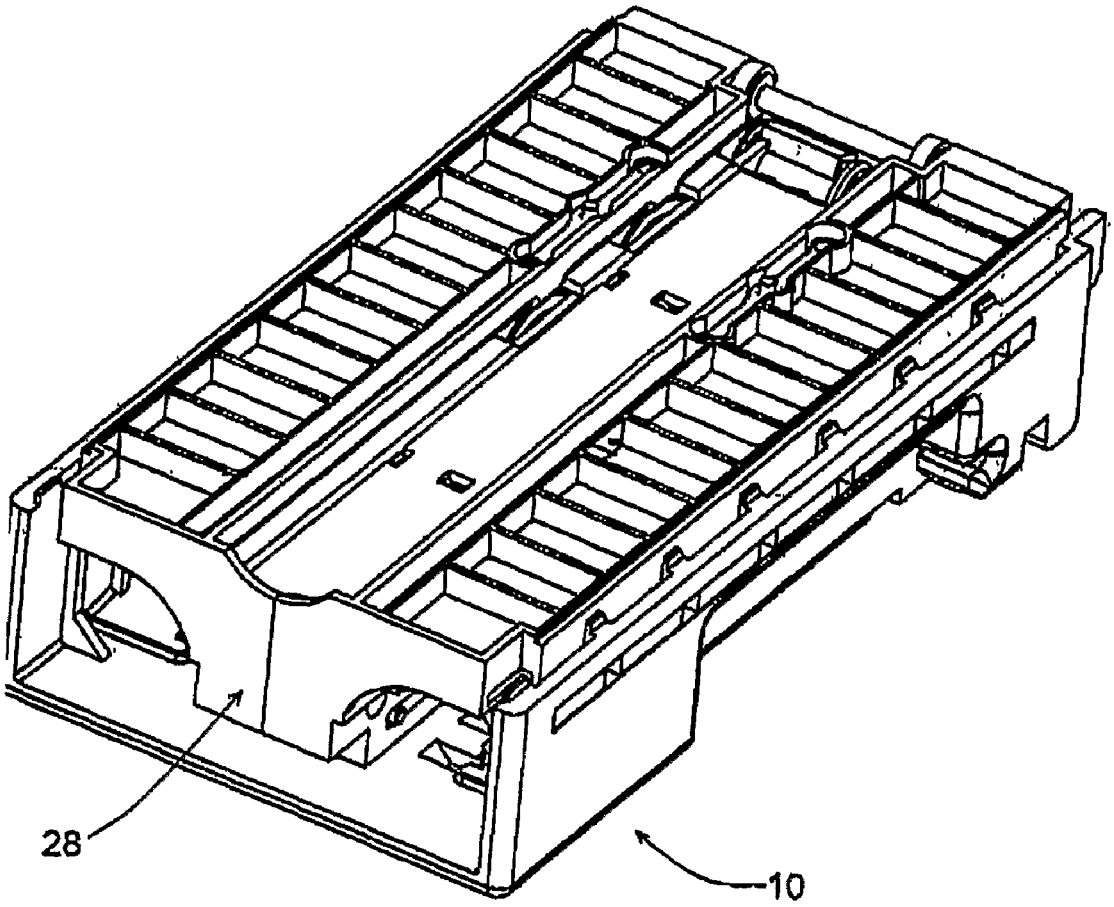
FIG. 10 is a perspective view of the assembled stacker end cap and stacker mechanism.

The assembled stacker mechanism 28 and stacker endcap 10 are shown in FIG. 10.

Figure 11:
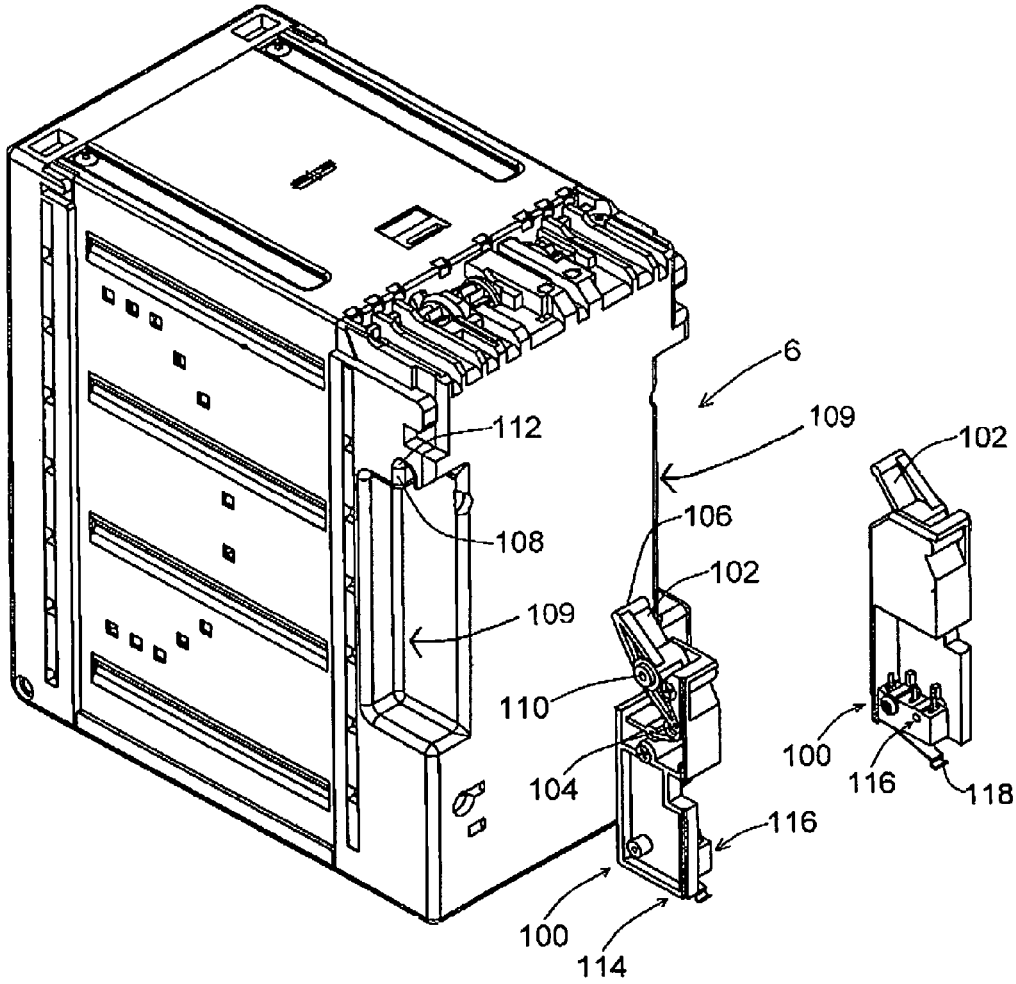
FIG. 11 is a perspective view of the banknote cassette and a retaining latch arrangement of the validator system.
Figure 12:
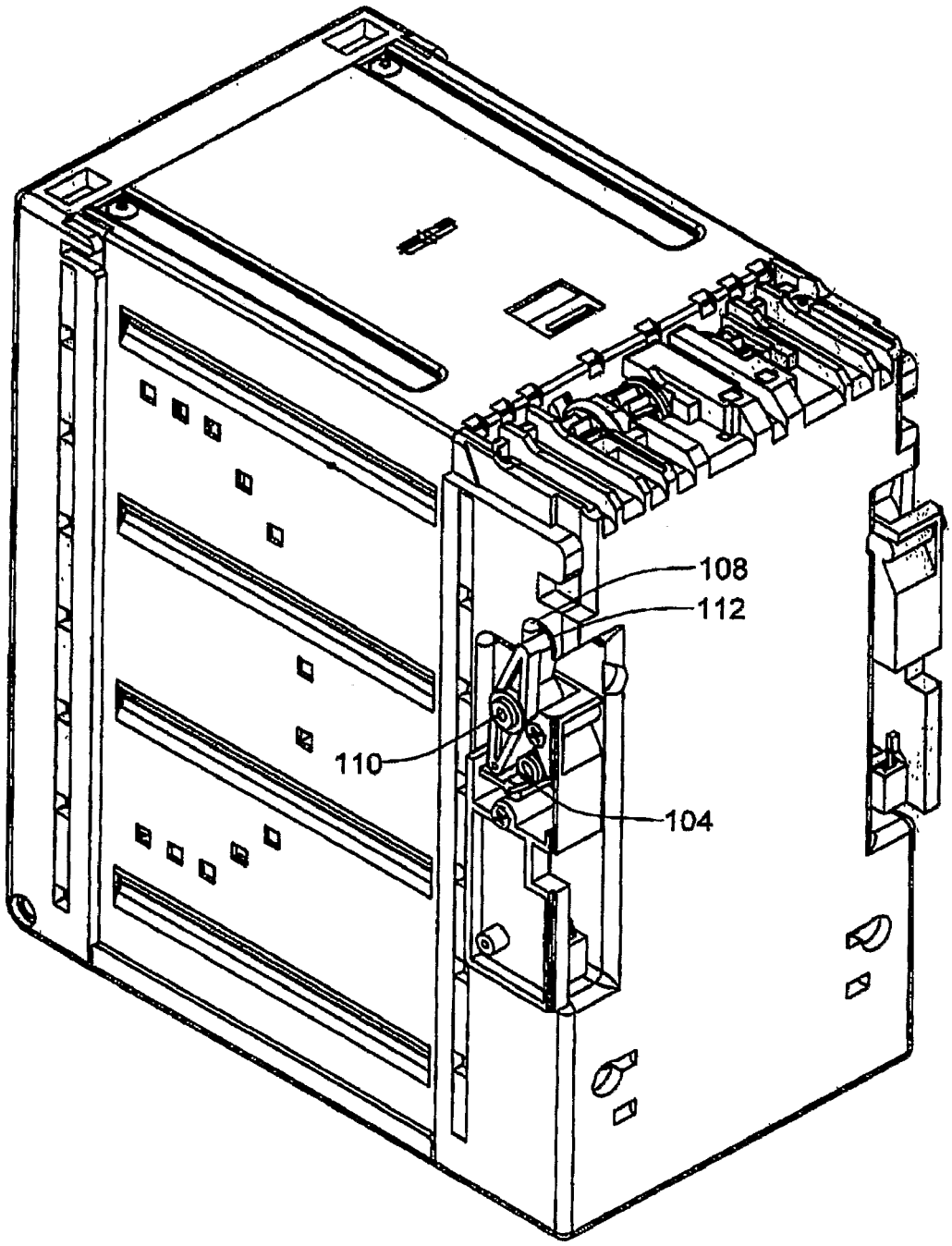
FIG. 12 is a perspective view of the latch arrangement retaining the banknote cassette.

FIG. 11 illustrates the banknote cassette 6 having alignment slots 109 about to be received by the opposed latches 100 that would be secured in a frame of the banknote validator system. Each latch includes a spring loaded toggle 102 shown in the release position in FIG. 11 and in an engaged position in FIG. 12. Coil spring bias 104 urges the toggle 102 to either the release position of FIG. 11 or the engaged position of FIG. 12.

The forward edge 106 of the toggle strikes face 108 when the banknote cassette is inserted and causes the toggle to rotate about pivot axis 110. The curved latching recess 112 of the cassette cooperates with the spring bias to move the cassette to a consistent received position.

The lower surface 114 of the latch can include a switch 116 with an actuating arm 118. The actuating arm 118 is moved upwardly by the cassette closing the switch when the cassette is properly received. Logic of the validator is used to process the signal as part of the banknote cassette loading confirmation. This signal can also be used to actuate an alarm if the cassette is removed without authorization.

This particular arrangement for a banknote cassette advantageously uses shallow endcaps 10 and 12 in combination with an interconnecting sleeve 14 preferably of a metal construction for defining of the rectangular housing 8. A suitable access lid 16 is provided at the open end of the container. With this arrangement, the endcaps can remain the same for banknote cassettes of different capacities. As can be appreciated, the interconnecting sleeve 14 can be made of additional depth to thereby define a banknote cassette of additional capacity. In some cases, if the capacity becomes large enough, an additional biasing arrangement may be required. Typically the stacker endcap 10 and the stacker mechanism remain the same, regardless of the capacity. This arrangement provides a structure where the tooling for the endcaps can be justified based on the manufacture of essentially a number of different capacity banknote cassettes. The actual endcaps and stacking mechanism can have significant detail and undercutting as the endcaps are not particularly deep and the higher cost of any movable portions of the mold are easily justified. Different interconnecting sleeves are required for different capacities but these components are relatively inexpensive and the tooling is relatively simple. The edge profile of the sleeves remains the same. The interconnecting sleeve is preferably of metal and produced by a metal stamping operation.

The sidewalls of the connecting sleeve can include viewing ports 87 for providing an indication of the number of banknotes stored, and the remaining capacity.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A banknote cassette for receiving and stacking banknotes comprising:

a rectangular housing closed by a movable access lid at a top of said rectangular housing;

said rectangular housing including two plastic molded endcaps forming opposite walls of said housing and cooperating with a metal sleeve defining three connected walls of said housing including a bottom of said housing opposite said lid, said plastic molded endcaps interconnecting with said sleeve portion to provide a fixed closed housing with the interior thereof being accessible through said access lid; and wherein one of said two endcaps is a stacker endcap having an interior surface that receives and retains a stacker mechanism within said stacker end cap and to one side of a banknote slot provided in an end wall of the cassette.

2. A banknote cassette as claimed in claim 1 wherein the other of said two endcaps is a storage endcap hingedly connected to one end of said access lid with an opposite end of said access lid having a releasable lock movable to lockingly engage said stacker end cap.

3. A banknote cassette as claimed in claim 1 wherein each endcap includes recessed walls receiving and locking with securing hook portions of said sleeve interior to said walls of said endcaps.

4. A banknote cassette as claimed in claim 1 wherein said storage endcap includes an integral molded spring retainer retaining a bias spring connected to a movable banknote pressure plate.

5. A banknote cassette as claimed in claim 1 wherein said other endcap is a storage endcap and said sleeve is mechanically secured to said storage endcap and said stacker endcap by hook portions of said sleeve received in recesses defined within walls of said end caps.

6. A banknote cassette as claimed in claim 1 wherein said stacker endcap is elongate and includes a recessed end wall that receives a drive portion of said stacker mechanism exposed on the exterior of said cassette.

7. A banknote cassette as claimed in claim 6 wherein said exposed drive portion of said stacker includes a banknote slot for receiving banknotes into said cassette.

8. A banknote cassette as claimed in claim 7 wherein said exposed drive portion includes drive rollers on opposite sides of said banknote slot.

9. A banknote cassette as claimed in claim 8 wherein said exposed drive portion includes a drive gear of said stacker mechanism.

10. A banknote cassette as claimed in claim 1 wherein said stacker endcap includes alignment slots on one end thereof and latching recesses in side walls and an end wall of said stacker endcap.

* * * * *